United States Patent [19]

Irelan

[11] 4,436,294

[45] Mar. 13, 1984

[54] ONE HAND CLAMPING DEVICE

[76] Inventor: Robert L. Irelan, 500 Fitch St., Socorro, N. Mex. 87801

[21] Appl. No.: 351,261

[22] Filed: Feb. 22, 1982

[51] Int. Cl.[3] ..... B66F 3/00

[52] U.S. Cl. ..... 269/6; 74/127; 74/130; 269/227; 269/243; 269/249

[58] Field of Search ..... 269/3, 4, 6, 243, 249, 269/88, 227, 225; 254/98, 95–97, 103, 108–111; 81/61, 62; 74/127, 130, 109, 577 R, 577 S, 575

[56] References Cited

U.S. PATENT DOCUMENTS

| | | | |
|---|---|---|---|
| 1,400,447 | 12/1921 | McGann | 254/95 |
| 1,483,251 | 2/1924 | Swain | 254/98 |
| 2,234,220 | 3/1941 | Antonietti | 254/98 |
| 2,544,329 | 3/1951 | Kirk | 269/4 |
| 2,790,478 | 4/1957 | Shapiro | 269/243 |
| 2,882,774 | 4/1959 | Guttfeld | 269/4 |
| 3,196,238 | 7/1965 | Freund et al. | 74/109 |
| 3,709,465 | 1/1973 | Valade | 254/95 |
| 4,185,811 | 1/1980 | Long | 269/6 |
| 4,220,322 | 9/1980 | Hobday | 269/6 |
| 4,253,648 | 3/1981 | Meeks | 269/6 |
| 4,339,113 | 7/1982 | Vosper | 254/98 |

*Primary Examiner*—Robert C. Watson

*Attorney, Agent, or Firm*—John W. Huckert

[57] ABSTRACT

A one hand clamping device which is flexible and reversible in operation, comprises a hand held main unit having mounted thereon a C-shaped clamping structure which is also changeable in relative position with the main unit, an actuating grip together with quandrant segment gear actuated thereby, rack bar driven from the gear action driven from the quandrant segment gear and integral with a slidable receptacle for supporting one-way drive structure for an actuating drive gear for in turn an elongated clamping screw which is mounted so as to be movable in and out of the hand held unit. The elongated clamping screw is provided with a slot therein for reception of a guide plate also mounted in the main unit to prevent rotation of the screw but to permit longitudinal movement thereof in and out of the main unit.

11 Claims, 6 Drawing Figures

ONE HAND CLAMPING DEVICE

BACKGROUND OF THE INVENTION

1. Field of the Invention

This invention relates generally to devices for clamping work pieces and the like wherein the device can be held and operated using only one hand.

2. Description of the Prior Art

A common problem with known clamping devices is that generally both hands of the user of the device must be employed during the clamping operation thereof. Thus another person is needed to hold the actual work piece itself, and/or assist in the overall clamping operation, or other holding structure must be employed.

Another problem of known type clamping devices is that they require torque resistance for operation and therefore cannot be readily used in space or under water.

A further problem with known type devices is that oftentimes they are not reversible in operation or arrangement for use with different types of work pieces.

A further problem with known type clamping devices is that generally they do not combine a C-clamp structure with jack mechanism. In many applications this arrangement is highly desirable.

Existing prior patents which may be pertinent to this invention are as follows:

| | | |
|---|---|---|
| W. H. McGann | 1,400,447 | Dec. 13 1921 |
| J.A. Kehoe | 2,836,394 | May 27, 1958 |
| J. Sholick | 2,933,288 | Apr 19, 1960 |
| R. H. Bishop | 3,049,328 | Aug. 14, 1962 |
| W. F. Mietla | 3,566,804 | Mar. 2, 1971 |
| V. D. Valade | 3,709,465 | Jan. 9, 1973 |
| S. Yonekura | 4,022,429 | May 10, 1977 |
| J. P. Cleary | 4,279,553 | Jul. 21, 1981 |

The McGann patent is the only one listed showing a combination of a C-clamp with a jack, but in this patent the jack is used for the specific purpose of forcing a door open rather than as a hand-operated clamping structure. The other patents teach minor features of the present invention, but none of them disclosing the unique combination of the present invention.

SUMMARY OF THE INVENTION

An object of the present invention is to provide a one hand clamping device which can be held and operated for clamping various type of work pieces while being held in just one hand of the user thereof.

Another object of this invention is to provide a one hand held and operated clamping device wherein a clamping screw moves in and out of the main hand-held unit without rotating and thus does not tend to twist out of position when engaged with a work piece.

A further object of this invention is to provide a clamping device which requires no external torque which is very advantageous for clamping purposes in space or under water.

A still further object of this invention is to provide a combination clamping device having reversibility of operation and reversibility of an associated C structure which is used to engage the other side of a work piece to be clamped.

The one hand clamping device of the present invention has a number of new and unique features not previously known or disclosed in the prior art. A main hand-held unit comprising a handle portion and a head portion has mounted on the head portion a C-shaped structure which is generally in a relatively fixed relationship with the head portion. However, this C-shaped structure is detachable from the head unit and reversible in relationship thereto for increasing the flexibility of use and operation of the overall clamping device.

In addition to the C-shaped clamping structure of the device, an elongated screw extends externally from the head portion of the main unit and has the rest of the screw movable in and out of the head as well as the handle portion of the main unit. Also mounted internally of the main unit is a rotatable gear for actuation of the elongated screw, and a slidable compartment together with rack bar with the rack bar being actuated by a quandrant segment gear. This quandrant segment gear in turn is actuated by a hand-operated handle appropriately suspended from the main unit and located so as to be grippable by the fingers of the hand holding the main unit. One-way drive structure is also provided between the slidable compartment and the screw actuating drive gear for permitting reversibility of drive of the gear.

A removable drive plate mounted in the head portion of the main unit engages with a slot along the length of the clamping screw for the purpose of preventing rotation of the screw in normal operation. The guide plate can be disengaged from the slot in order to make an initial positioning and adjustment of the elongated screw clamp structure against a work piece to be clamped. However, once the initial adjustment is made, then the guide plate is again positioned within the slot and the screw, thus ensuring that the screw moves in and out of the main unit because of rotation of the drive gear but without any rotation of the screw itself.

The clamping device of this invention is very useful and especially so because it can be operated and held in just one hand of a user of the device, and does not require torque resisting means external of the device for proper operation thereof. Thus, the device can be used in space and/or under water and in various other environments where such external torque is nil. The device is also flexible and reversible in operation and use.

These together with other objects and advantages which will become subsequently apparent reside in the details of construction and operation as more fully hereinafter described and claimed, reference being had to the accompanying drawings forming a part hereof, wherein like numerals refer to like parts throughout.

DESCRIPTION OF THE PREFERRED EMBODIMENTS

Figure 1:
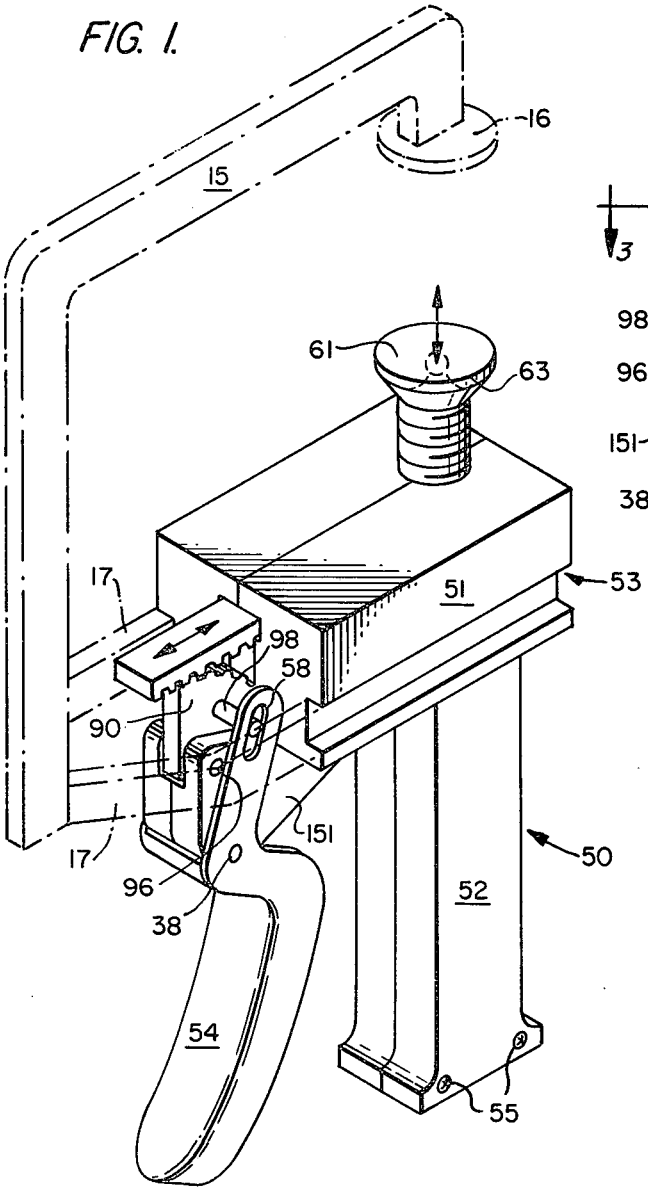
FIG. 1 is a perspective view of the main hand held unit together with the reversible C-shaped structure.

Looking at FIG. 1 of the drawings, the overall clamping device of the present invention can be seen in detail. A main unit 50 having a head portion 51 and a hand held portion 52 is shown. The head portion 51 has parallel recesses 53 on opposite sides thereof for reception of the C attachment 15. This C attachment 15 has split and divergent members 17 for reception in the recesses 53 of the head portion of the main unit. Thus, while the C attachment is relatively fixed with respect to the head unit 51 during operation of the device, it is removable and reversible so that the C attachment can face forward or backward in relation to the main unit and the user of the device. The outer end of the C attachment is preferably provided with a work piece engaging disc 16.

Figure 2:
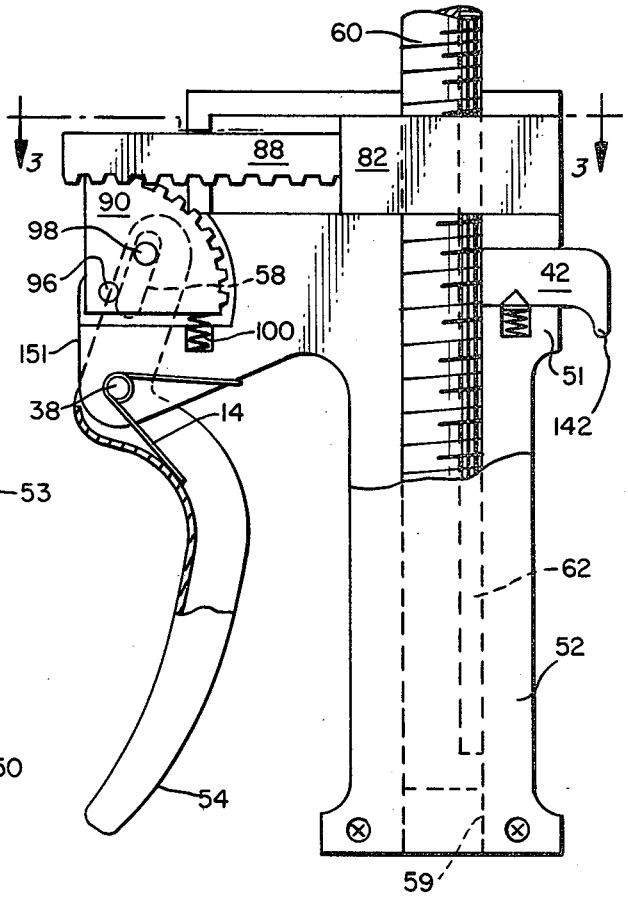
FIG. 2 is a side elevational view of the hand held main unit, partly broken away, and showing some of the internal operating mechanism together with the hand grippable actuating handle in extended position.
Figure 5:
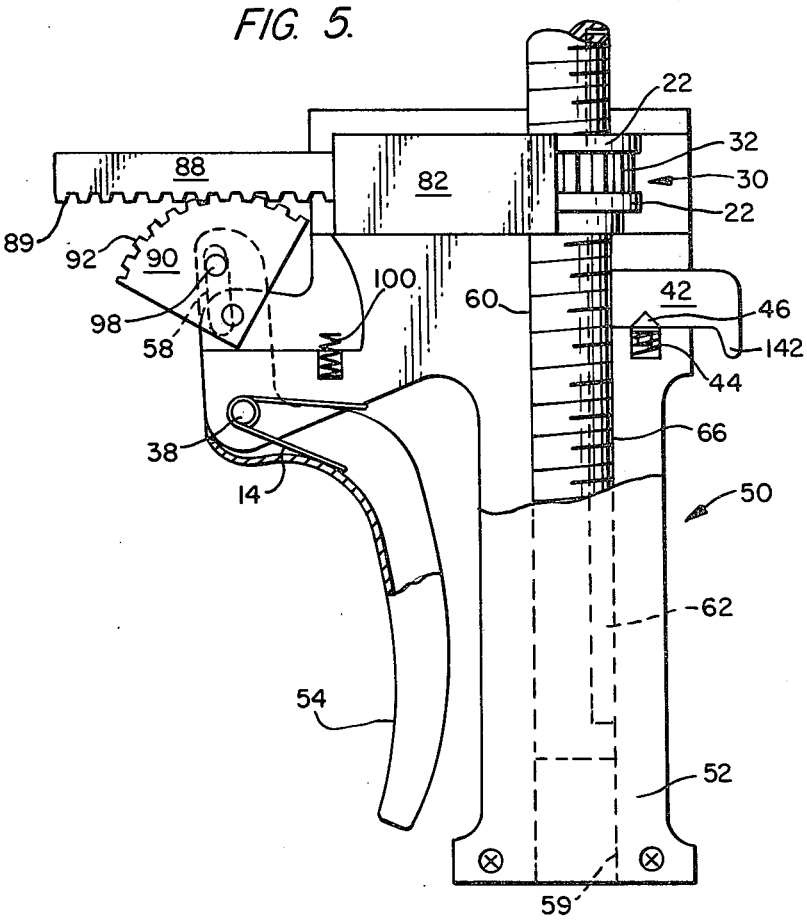
FIG. 5 is a view similar to that of FIG. 2, but with the actuating handle in the compressed position thereof.

The main unit 50 comprises two halves with each half having part of the head unit 51 and handle 52 therewith and thus internally thereof appropriately recessed to contain the operating structure for the device. Each head portion 51 also has an extension 151 for supporting the pivotally mounted actuating grip 54. A pin 38 normally passes through appropriate apertures in the grip 54 and the extensions 151. Also supported by extensions 151 by a suitable axle 96 is a rotatable quandrant segment gear 90. This quandrant segment gear 90 has an extending pin 98 which slides in elongated slot 58 at the other end of the actuating handle 54. Thus, as can be easily visualized, when a user squeezes the fingers of a hand holding handle 52 about actuating grip 54, the grip 54 moves toward handle 52 and in turn because of slot 58 effects turning of quandrant segment gear 90 in a counter-clockwise direction around axle 96 as shown in FIGS. 1, 2, and 5.

Also, supported within appropriate recesses within the head portions 51 is a slidable compartment 82 together with a rack bar 88. The rack bar 88 is driven from the quandrant segment gear 90 when the actuating grip 54 is squeezed. A return spring 14 effects outward movement of the actuating grip 54 when a user's grip is relaxed and in turn effects return movement of the quandrant segment gear 90 and the rack bar 88 to the initial starting position. This initial starting position is best seen in the cross-sectional view of FIG. 3. In this figure, the slidable compartment 82 is at the right most position within the head portion 51.

Figure 6:
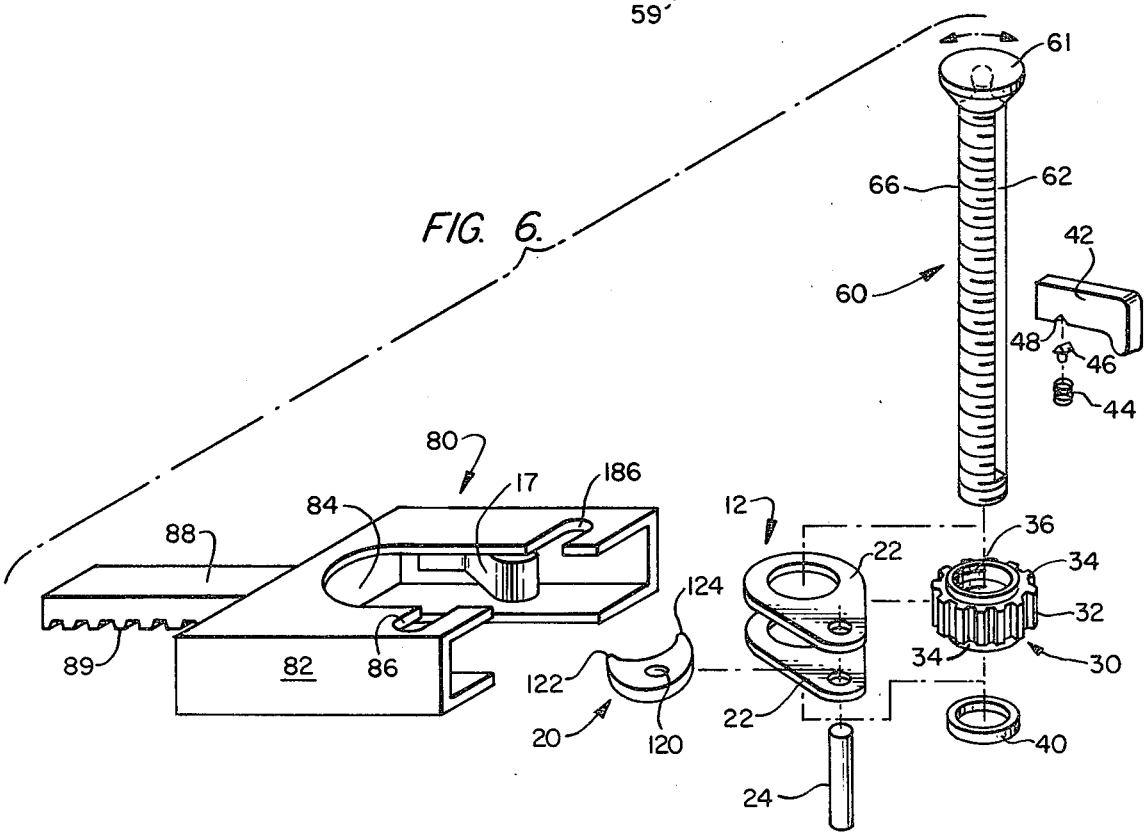
FIG. 6 is an exploded perspective view of the reversible actuating pawl structure together with screw drive gear and elongated screw, slot therein, and guide plate normally associated therewith.

Looking at FIG. 6, the drive gear 30 is clearly shown together with the supporting plates 22, a one-way drive pawl 20, and the internal spring 17 for cooperation with this pawl. When the device is assembled, the compartment 80 having the main compartment structure 82 with slots 86, 186 therein and the springs 17 mounted inside thereof. The slots 86, 186 extend outwardly from the enlarged recess 84 in the top portion of the compartment.

Also supported within the main unit is an elongated clamp screw 60 having external threads 66 thereon. Also an elongated slot 62 is provided lengthwise of the screw for association with the guide plate 42. The guide plate 42 is mounted in the head portion 51 and retained in guide relationship to the slot 62 of the elongated screw by means of a wire spring 44 and a retention detent 46. The detent 46 is biased by the spring 44 into engagement with a V-shaped recess 48 on the lower edge of the guide plate 42. Thus, as can best be seen in FIG. 2, when the guide plate 42 is in proper position with slot 62 to prevent rotation of the elongated screw 60, the detent 46 will retain same in this engaged position. However, by gripping the small depending handle 142, the guide plate 42 can be quite easily removed from operating position. Once removed, the screw 60 then can be rotated for the purpose of making the initial clamping adjustment. Obviously, this initial adjustment can be made more easily and quickly if screw 60 is rotatable during this time. After the initial positioning of the clamping screw 60 so that the pivotally and rotatably mounted clamping engaging head 61 is touching a suitable work piece, then the guide plate 42 can be repositioned into operating relationship thereto.

Figure 3:
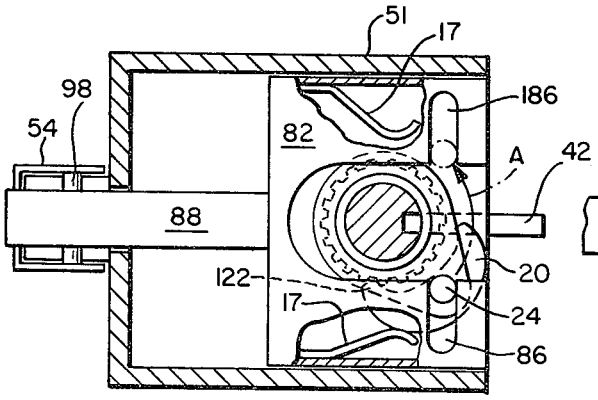
FIG. 3 is a view taken generally along lines 3—3 of FIG. 2.
Figure 4:
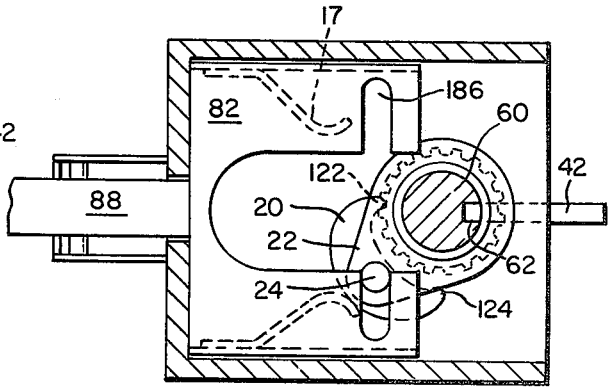
FIG. 4 is a view similar to FIG. 3, but with the position of the slidable compartment at the opposite end of its travel from that of FIG. 3.

The reversible and one-way actuating structure for the drive gear 30 will now be described in detail. Looking at FIGS. 3, 4, and 6, especially, this structure and manner of operation can be seen. The drive gear 30 has teeth 32 externally thereof, and threaded portion 36 internally thereof. The shoulder portions 34 of gear 30 permit the gear to be rotatably retained between support plates 22. The support plates 22 in combination with gear 30 form the actuating drive unit 12 of the device. At least one bearing 40 is preferably used with gear 30, but of course bearings on each side of the gear may also be employed, though only one is shown. A double ended pawl 20 is also supported between the support plates 22 by means of the pin 24 and an appropriate aperture 120 in the central portion of the pawl. When the entire structure 12 is mounted within slidable compartment 82, the opposite springs 17 will engage the pawl near one end or the other to insure that one tip 122 or the other 124 will engage with external teeth 32 of drive gear 30. This is best seen in FIGS. 3 and 4 of the drawings. The pin 24 also plays another important function for the overall structure and for the reversibility thereof. That is, when pin 24 is in proper operation, it must be within one slot 86 or the other 186 of the compartment 82. As shown in solid lines in FIGS. 3 and 4, pin 24 is in the lower slot 86 in these figures. In this position, the pawl end 122 will engage with teeth 32 and will effect a one-way drive of gear 30 as the slidable compartment 82 is caused to move back and forth by rack bar 88. However, when it is desired to reverse the direction of operation of gear 30, the end of rack bar 88 at the leftmost portion of FIG. 3 is pushed towards the right, to cause the quandrant gear 90 to push against the small limit stop spring 100 as shown in FIG. 2. When in this right most position of FIG. 3, the one-way structure 12 can be rotated counter-clockwise (arrow A) so that pin 24 engages with slot 186. With the pin 84 in this slot, the double ended pawl will have the end 124 in engagement with the teeth 32 of drive gear 30. Thus, in this position actuation of the drive gear 30 will be opposite to that just described. As shown in FIG. 3, the tip 122 of the pawl 20 is caused to be in engagement with the gear 30 teeth by the spring 17. Likewise when in the reversed position of actuation, the other spring 17 will cause the tip 124 to be in engagement with drive gear 30. Thus, as can be now visualized, when the actuating grip 54 is compressed, movement of slidable compartment 82 will be effected through quandrant segment gear 90 and rack bar 88, which in turn will effect movement of the pawl 20 to cause rotation in the appropriate direction of the screw drive gear 30. Of course, as the screw drive gear 30 rotates it will through the internal threads 36 thereof and the external threads 66 of the elongated screw 60, effect movement of this screw for clamping a work piece. The actuating gear 30 as well as the elongated screw 60 may be provided with double or triple threads in order to increase the speed of movement thereof, but of course with single threads, the effective force is greater even though the speed is less.

This device can be very quickly and easily initially positioned so as to clamp a work piece, and then by one hand gripping and squeezing the handle and actuating grip, the clamping screw 60 is effectively moved toward the stationary portion of the C structure opposite thereto. Thus, the squeezing force of one's hand is effectively used to achieve a very positive and strong gripping and clamping action. The fact that the device is also reversible in operation and positioning is another important feature of the present invention.

The foregoing is considered as illustrative only of the principles of the invention. Further, since numerous modifications and changes will readily occur to those skilled in the art, it is not desired to limit the invention to the exact construction and operation shown and described, and accordingly all suitable modifications and equivalents may be resorted to, falling within the scope of the invention.

I claim:

1. A clamping device comprising:

a main unit holdable in one hand by a user of the device;

first clamp means mounted on the main unit in a relatively fixed relationship thereto for engagement with one side of a work-piece to be clamped;

second clamp means mounted on the main unit in movable relationship thereto for in and out movement relative to the main unit for engaging the opposite side of the workpiece;

activating means for effecting the in and out movement of said second clamp means by the same hand holding the main unit;

means for permitting reversibility of operation of the device;

said second clamp means including an elongated screw mounted in said main unit with one end thereof extending out of said main unit, said elongated screw having means associated therewith for preventing rotation thereof;

said means for preventing rotation of said elongated screw consists of a slot lengthwise of the screw, and a guide plate removably mounted in the main unit which engages in the slot to prevent screw rotation;

said main unit having head and handle portions, the head portion receiving said guide plate, the guide plate having a recess therein, and a spring mounted detent also in the head portion which cooperates with said recess to resiliently retain the guide plate in the head portion.

2. A clamping device as in claim 1, wherein the end of said elongated screw which extends out of said main unit extends out of the head portion thereof, and this external end has a pivotal and rotatable tip thereon for directly engaging the work-piece.

3. A clamping device as in claim 1, wherein said activating means for effecting the in and out movement of said elongated screw includes a rotatable gear with internal threads which complement and drivingly engage threads external of said second clamp means, said activating means further including a hand grip which is operable by the user's hand, and connecting means for drivingly coupling movement of the hand grip to the rotatable gear.

4. A clamping device as in claim 1, wherein said means for permitting reversibility of operation includes the first clamp means being mounted on the main unit so that it can be removed, reversed, and replaced in an opposite facing position to its original relatively fixed position on the main unit.

5. A clamping device comprising:

a main unit holdable in one hand by a user of the device;

first clamp means mounted on the main unit in a relatively fixed relationship thereto for engagement with one side of a work-piece to be clamped;

second clamp means mounted on the main unit in movable relationship thereto for in and out movement relative to the main unit for engaging the opposite side of the work-piece;

activating means for effecting the in and out movement of said second clamp means by the same hand holding the main unit;

means for permitting reversibility of operation of the device;

activating means for effecting the in and out movement of said second clamp means including a rotatable gear with internal threads which complement and drivingly engage threads external of said second clamp means, said activating means further including a hand grip which is operable by the user's hand, and connecting means for drivingly coupling movement of the hand grip to the rotatable gear;

said connecting means includes a slidable compartment with rack bar connected thereto, said rack bar having teeth engageably driven from a quandrant segment gear, which quandrant gear in turn is actuated by said hand grip.

6. A clamping device as in claim 5, wherein said second clamp means includes an elongated screw mounted in said main unit with one end thereof extending out of said main unit, said elongated screw having means associated therewith for preventing rotation thereof.

7. A clamping device as in claim 6, wherein said means for preventing rotation of said elongated screw consists of a slot lengthwise of the screw, and a guide plate removably mounted in the main unit which engages in the slot to prevent screw rotation.

8. A clamping device as in claim 5, wherein said slidable compartment is slidably mounted in a head portion of the main unit and receives therein the screw drive gear, a one-way drive means between the slidable compartment and the screw drive gear, and a pin and slot coupling between the hand grip and the quandrant segment gear.

9. A clamping device as in claim 8, wherein said one-way drive means includes a pair of support plates for holding the screw drive gear therebetween and a pivotably mounted pawl also supported between said plates which is engageable with external teeth provided on the screw drive gear.

10. A clamping device as in claim 9, wherein said further means for permitting reversibility of operation includes the pawl being double ended, and said support plates supporting said pawl being arranged for shiftable drive engagement with the slidable compartment in either one of two positions.

11. A clamping device as in claim 10, wherein said means for permittng reversibility of operation includes the first clamp means being mounted on the main unit so that it can be removed, reversed, and replaced in an opposite facing position to its original relatively fixed position on the main unit.

* * * * *